US005357647A

United States Patent [19]

Gueret

[11] Patent Number: 5,357,647

[45] Date of Patent: Oct. 25, 1994

[54] BRUSH FOR THE APPLICATION OF NAIL VARNISH OR A SIMILAR PRODUCT

[75] Inventor: Jean-Louis H. Gueret, Paris, France

[73] Assignee: L'Oreal, Paris, France

[21] Appl. No.: 13,737

[22] Filed: Feb. 4, 1993

[30] Foreign Application Priority Data

Feb. 11, 1992 [FR] France ..... 92 01498

[51] Int. Cl.[5] ..... A46B 9/06

[52] U.S. Cl. ..... 15/159.1; 15/207.2; 15/DIG. 6

[58] Field of Search ..... 15/159.1, 207.2, DIG. 6; 401/129

[56] References Cited

U.S. PATENT DOCUMENTS

| | | | |
|---|---|---|---|
| 3,153,800 | 10/1969 | Trotin | 15/207.2 |
| 3,186,018 | 6/1965 | Shaw | 15/207.2 |
| 3,668,732 | 6/1972 | Lardenois | 15/207.2 |
| 4,861,179 | 8/1989 | Schrepf | 15/207.2 |
| 4,927,281 | 5/1990 | Gueret | 15/207.2 |
| 4,958,402 | 9/1990 | Weihrauch | 15/207.2 |
| 4,998,315 | 3/1991 | Pessis . | |
| 5,161,554 | 11/1992 | Fitjer | 15/207.2 |
| 5,216,467 | 6/1993 | Esser | 15/159.1 |

FOREIGN PATENT DOCUMENTS

| | | |
|---|---|---|
| 0239270 | 9/1987 | European Pat. Off. . |
| 1083891 | 9/1967 | United Kingdom . |

*Primary Examiner*—David A. Scherbel
*Assistant Examiner*—Terrence R. Till
*Attorney, Agent, or Firm*—Cushman, Darby & Cushman

[57] ABSTRACT

The brush comprises bristles (*2a, 2b*) disposed substantially parallel to one another and fixed in a tuft to a support. The bristles are formed by a mixture of bristles (*2a*) of small section, or small bristles, and bristles (*2b*) having a larger section, or large bristles, the proportion of large bristles being between 2% and 95% by volume in relation to the total volume of the tuft of the brush.

21 Claims, 1 Drawing Sheet

BRUSH FOR THE APPLICATION OF NAIL VARNISH OR A SIMILAR PRODUCT

FIELD OF THE INVENTION

The invention relates to a brush for the application of nail varnish or a similar product, of the type comprising bristles disposed substantially parallel to one another in a tuft and fixed to a support.

BACKGROUND OF THE INVENTION

The brushes proposed hitherto generally ensure relatively satisfactory making up, but it is desirable to be able to improve the precision and speed of making up, especially the precision of the application of nail varnish or a similar product.

Moreover, with a conventional brush, the brush often has to be dipped into the container several times in order to make up a nail as the product load taken up by the brush is relatively light. Various solutions have already been proposed to obviate this disadvantage and to incorporate a sort of storage tank into the shaft of the brush, but these solutions complicate the manufacture and use of the brush.

SUMMARY OF THE INVENTION

The aim of the invention is above all to provide a brush which no longer displays, or displays to a lesser extent, the abovementioned disadvantages and which allows for precise, rapid making up.

According to the invention, a brush for the application of nail varnish or a similar product, comprising bristles disposed substantially parallel to one another in a tuft and fixed to a support is characterised in that the bristles are formed by a mixture of bristles of small section, or small bristles, and bristles having a larger cross section, or large bristles, the proportion of large bristles being between 2% and 95% by volume in relation to the total volume of the tuft of the brush, and preferably between 10% and 90%.

The small bristles preferably have a section inscribed in a circle having a diameter of between 4 hundredths and 10 hundredths of a millimeter, while the large bristles have a section inscribed in a circle having a diameter of between 11 hundredths and 40 hundredths of a millimeter. The section of the large bristles is advantageously inscribed in a circle having a diameter of between 14 hundredths and 17 hundredths of a millimeter.

The length of the tuft of bristles is generally between 11 and 25 mm, and in particular between 13 and 20 mm. The large bristles and the small bristles may have the same length. As a variant, they may not have the same length, the difference in length then being between 0.1 and 2 mm.

By virtue of the presence of the large bristles, it is possible to produce longer tufts, greater than 13 mm, so that upon application it is possible to obtain different curvatures of the brush from those of a normal brush, the tuft length of which is between 11 and 13 mm. This facilitates the application of the varnish and increases its performance.

When the bristles are made of plastic or natural material, the material forming the bristles is advantageously selected from the group formed by polyamides, polyesters, polyether block amides, polyethylene, polytetrafluoroethylene, polyvinylidene fluoride, polyacetals and natural silks, preferably of animal origin.

When the bristles consist of a polyamide, the latter is advantageously selected from the group of polyamides 6, 6–6, 6–10, 6–12 or 11.

If the brush is intended for the application of a nail varnish or a similar product having a low viscosity, especially a viscosity lower than 0.6 Pa s, corresponding to a liquid formulation, the mixture of bristles of the brush includes approximately 90 to 95% by volume of large bristles in the tuft in order to ensure a sufficient storage effect.

In the case of a brush in which the bristles are made of plastic, an agent improving the sliding properties of the bristle and reducing its absorptivity with respect to water and/or solvent is advantageously incorporated into the material of the bristles, in a proportion of between 0.2% and 15% by weight.

This sliding agent is preferably selected from the group formed by polytetrafluoroethylene, boron nitride and molybdenum disulphide.

At least some of the bristles may have slight undulations over their length.

The bristles may have sections the shape of which is selected from the group of shapes consisting of circular, polygonal, cross-shaped, annular, flat or U-shaped. The bristles may have at least one capillary groove.

The ends of the bristles may be designed as pin-heads, especially obtained by heat treatment.

The ends may also be subjected to an abrasive treatment. e.g. grinding.

The cross section of the brush may have different shapes, inter alia, flat, circular, or may be in the shape of a semi-circular tile so that it corresponds better in shape to the bulb of the nail.

The end of the brush may be flat or rounded.

The bristles are fixed to the shaft with the aid of a hook with either a circular section having a diameter of between 0.5 and 1.5 mm or a rectangular section having dimensions 1.5×0.2 mm.

The end of the shaft to which the tuft of bristles is fixed may have a cone-shaped edge to allow the bristles to move apart from one another.

BRIEF DESCRIPTION OF THE DRAWINGS

In addition to the arrangements described hereinabove, the invention consists of a number of other arrangements which will be described in more detail hereinafter by way of embodiments which are by no means limiting and which are described with reference to the accompanying drawings, in which.

DETAILED DESCRIPTION OF THE INVENTION

Figure 1:
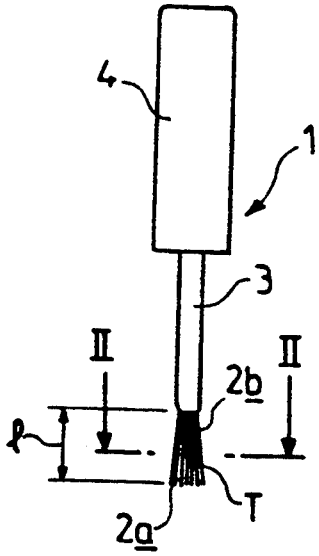
FIG. 1 is a simplified elevation of a brush according to the invention.

Referring to FIG. 1 of the drawings, it shows a brush 1 for the application of nail varnish, comprising bristles 2a, 2b disposed substantially parallel to one another in a tuft and fixed to a support formed by a shaft 3. The tuft of the bristles 2a, 2b is fixed to the lower end of the shaft 3, the axis of which is substantially parallel to the bristles of the tuft. The shaft 3 is integral at its other end with a cylindrical sleeve 4 serving as a control member for the brush and as a stopper intended, e.g. to be screwed by virtue of an internal thread not visible in FIG. 1 on to the neck of a varnish bottle.

Although the brush shown shows bristles 2a, 2b pointing in the longitudinal direction of the support formed by the shaft 3, it is clear that the invention also applies to a brush in which the bristles are fixed in a direction substantially perpendicular to the principal direction of the support.

According to the invention, the bristles of the brush are formed by a mixture of bristles 2a of small section, or small bristles, and bristles 2b having a larger cross section, or large bristles, the proportion of the large bristles being between 2% and 95% by volume in relation to the total volume of the tuft T of the brush. The mixture of the bristles 2a, 2b may be statistical or may be according to a predetermined geometric arrangement of the bristles 2b, e.g. distributed in a ring.

The cross sections of the small bristles 2a are generally inscribed in a circle having a diameter of between 4 hundredths and 10 hundredths of a millimeter, while the sections of the large bristles 2b are generally inscribed in a circle having a diameter of between 11 hundredths and 40 hundredths of a millimeter. The sections of the large bristles are preferably inscribed in a circle having a diameter of between 14 hundredths and 17 hundredths of a millimeter.

Figure 3:
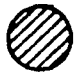
FIGS. 3 to 7 show various possible shapes for the cross sections of the bristles of the brush on a larger scale.
Figure 4:
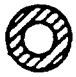
Figure 5:
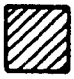
Figure 6:
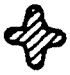
Figure 7:
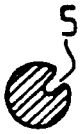

The sections of the bristles 2a, 2b may have variable shapes. They may be solid circular, as shown in FIG. 3, or hollow circular, as shown in FIG. 4, or polygonal, in particular square, as shown in FIG. 5, or cross-shaped (FIG. 6), circular with a capillary groove 5, as shown in FIG. 7, or U-shaped. The useful length l of the tuft of bristles T is between 11 and 25 mm, and preferably between 13 and 20 mm. The large bristles 2b have the same length as the small bristles 2a.

Figure 2:
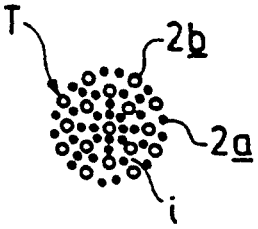
FIG. 2 is a simplified cross section on a larger scale along the line II—II of FIG. 1.

By virtue of the presence of large bristles 2b, as can be seen in FIG. 2, the spaces i between the bristles are larger and serve as a capillary store for the product to be applied. This makes it possible to obtain a-brush 1 more loaded with product in its tuft T when this tuft has been dipped into the supply of liquid product. The small bristles 2a have a "smoothing" function perfect for finishing.

Depending on the viscosity of the liquid product to be applied, the storage effect of the tuft T of bristles of the brush can be controlled by varying the proportion of large bristles 2b. E.g. in the case of a liquid nail varnish formulation having relatively low viscosity, e.g. of the order of 0.2 Pa s, the tuft T will contain large bristles 2b to approximately 90 to 95% by volume of the tuft.

Figure 8:
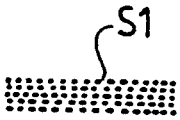
FIGS. 8, 9 and 10 show various possible shapes for the cross section of the tuft of the brush.
Figure 9:
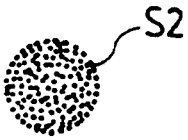
Figure 10:
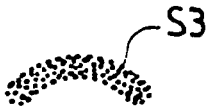

The brush 1 may have different cross-sectional shapes at its tuft T. According to FIG. 8, the cross section S1 of the tuft T is flat, of substantially rectangular shape. According to FIG. 9, the section $2 is circular as in FIG. 2. According to FIG. 10, the tuft T has a cross section S3 in the shape of a semi-circular tile so that it corresponds better in shape to the bulb of the nail.

Figure 11:
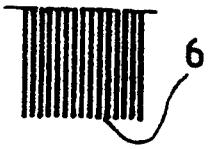
FIGS. 11 and 12 are elevations on a larger scale of two possible shapes for the end of the brush.
Figure 12:
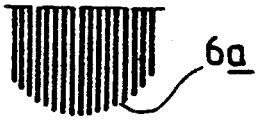

The end 6 of the tuft T may be flat, i.e. rectilinear transversely, as shown in FIG. 11, or may be rounded, as shown by the end 6a in FIG. 12. As a variant, the end of the brush may be tapered by abrasion.

Figure 13:
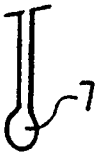
FIG. 13 shows the end of a bristle designed as a pin-head on a larger scale, and finally

The ends of the bristles, in particular the large bristles 2a, may have the shape of a bulge 7, like a pin-head, as shown in FIG. 13, obtained, e.g. by heat treatment.

Figure 14:
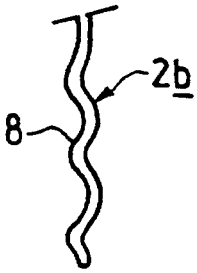
FIG. 14 shows a bristle having slight undulation.

As shown in FIG. 14 for a large bristle 2b, the small or large bristles may not be rectilinear over their entire length and may have slight undulations 8 at least over part of their length.

The bristles 2a, 2b may be made of plastic, advantageously selected from the group formed by polyamides, polyesters, polyether block amides, polyethylene, polytetrafluoroethylene, polyvinylidene fluoride and polyacetates.

When the bristle is formed by a polyamide, polyamides 6, 6—6, 6-10, 6-12 or 11 can be used in particular.

An agent improving the sliding properties of the bristle and reducing its absorptivity with respect to water and/or solvent may be incorporated into these materials, in a proportion of between 0.2 and 15% by weight. The sliding agent is advantageously selected from the group formed by polytetrafluoroethylene, boron nitride and molybdenum disulphide.

The mixture of small bristles 2a and large bristles 2b with sections inscribed in circles of different diameters can be arranged in various ways, namely:

bristles with sections inscribed in circles of different diameters, made of the same material;

bristles with sections inscribed in circles of different diameters, made with the same cross-sectional shape;

bristles with sections inscribed in circles of different diameters, made with different cross-sectional shapes;

bristles with sections inscribed in circles of different diameters, made of different materials;

bristles with different cross-sectional shapes, made of different materials.

The production of the brush according to the invention is of course not limited to the mixture of two different types of bristles. It is possible to use a mixture of three, four or five different types of bristles from among those mentioned hereinabove.

The brushes generally have between 100 and 600 bristles.

Embodiments of brushes according to the invention are given hereinafter.

EXAMPLE 1

Brush with an Apparent Length of 18 mm

50% cylindrical bristles of polyamide 11 (known by the trade name RILSAN), 15/100 mm, loaded with 5% of molybdenum disulphide, approximately 54 bristles.

50% cylindrical bristles of polyamide 6-12 (known by the trade name Nylon TYNEX sold by DUPONT DE NEMOURS), 8/100 mm, the ends of the bristles being ground, approximately 230 bristles.

EXAMPLE 2

Brush with an Apparent Length of 18 mm

10% cylindrical bristles of polyamide 11 (RILSAN), 15/100 mm, loaded with 5% of molybdenum disulphide, approximately 18 bristles.

90% cylindrical bristles of polyamide 6-12 (Nylon TYNEX), 8/100 mm, the ends of the bristles being ground, approximately 340 bristles.

EXAMPLE 3

Brush with an Apparent Length of 18 mm

90% cylindrical bristles of polyamide 11 (RILSAN), 15/100 mm, loaded with 5% of molybdenum disulphide, approximately 110 bristles.

10% cylindrical bristles of polyamide 6–12 (Nylon TYNEX). 8/100 mm, approximately 46 bristles.

EXAMPLE 4

Brush with an Apparent Length of 18 mm

50% cylindrical bristles with a capillary groove of polyamide 11 (RILSAN), 17/100 mm, loaded with 5% of molybdenum disulphide, approximately 15 bristles.

50% cylindrical bristles of polyamide 6–12 (Nylon TYNEX), 8/100 mm, approximately 95 bristles.

EXAMPLE 5

Brush with an Apparent Length of 17 mm

50% cylindrical bristles of polyamide 11 (RILSAN), 15/100 mm, loaded with 5% of molybdenum disulphide, approximately 54 bristles.

50% cylindrical bristles of polyamide 6–12 (Nylon TYNEX), 4/100 mm, ground ends, approximately 400 bristles.

EXAMPLE 6

Brush with an Apparent Length of 16 mm

50% cylindrical bristles of polyamide 6–12 (Nylon TYNEX), 10/100 mm, approximately 180 bristles.

50% cylindrical bristles of polyamide 6–12 (Nylon TYNEX), 6/100 mm, approximately 320 bristles.

By virtue of the bristles having a greater diameter, a brush according to the invention corresponds better in shape to the bulb of the nail and, as a result of the fact that it is not too soft, it allows for a pressure considerably increasing the precision of application.

The results of tests have proved surprising. Extreme ease of use, great precision and a marked increase in coverage and autonomy are noted with a brush according to the invention by virtue of the storage effect as a result of the large bristles.

I claim:

1. Brush for the application for nail coating product, comprising bristles disposed substantially parallel to one another in a tuft and fixed to a support, characterized in that the bristles are formed by a mixture of bristles of small cross section, and bristles having a larger cross section than said small cross section the proportion of large bristles being between 2% and 95% by volume in relation to the total volume of the tuft of the brush, said larger cross section bristles providing a means to increase a length of said tuft for more effective application of nail coating product, the length of said tuft of bristles being between 11 and 25 mm.

2. Brush according to claim 1, characterised in that the proportion of large bristles is between 10% and 90% by volume in relation to the total volume of the tuft (T) of the brush.

3. Brush according to claim 1 or claim 2, characterised in that the small bristles have a section inscribed in a circle having a diameter of between 4 hundredths and 10 hundredths of a millimeter, while the large bristles have a section inscribed in a circle having a diameter of between 11 hundredths and 40 hundredths of a millimeter.

4. Brush according to claim 3 characterised in that the section of the large bristles is inscribed in a circle having a diameter of between 14 hundredths and 17 hundredths of a millimeter.

5. Brush according to claim 1 characterized in that the length of the tuft of bristles is between 13 and 20 mm.

6. Brush according to claim 5, in which the bristles are a natural silk.

7. Brush according to claim 1, in which the bristles are made of plastic, characterised in that the material forming the bristles is selected from the group consisting of polyamides, polyesters, polyether block amides, polyethylene, polytetrafluoroethylene, polyvinylidene fluoride and polyacetals.

8. Brush according to claim 6, in which the bristles comprises a polyamide, characterised in that the polyamide is selected from the group consisting of polyamides consisting of 6, 6—6, 6–10, 6–12 and 11.

9. Brush according to claim 7, characterised in that an agent improving the sliding properties of the bristle and reducing its absorptivity with respect to water and solvent is incorporated into the material of the bristles, in a proportion of between 0.2% and 15% by weight.

10. Brush according to claim 9, characterised in that the sliding agent is selected from the group consisting of polytetrafluoroethylene, boron nitride and molybdenum disulphide.

11. Brush according to claim 1 for the application of a nail coating product having a low viscosity corresponding to a liquid formulation, characterised in that the mixture of bristles includes approximately 90 to 95% by volume of large bristles in the tuft.

12. Brush according to claim 1, characterised in that at least some of the bristles have slight undulations (8) over their length.

13. Brush according to claim 1, wherein the bristles have sections which are circular in shape.

14. Brush according to claim 1, wherein the bristles have sections which are polygonal in shape.

15. Brush according to claim 1, wherein the bristles have sections which are cross-shaped.

16. Brush according to claim 1, wherein the bristles have sections which are annular in shape.

17. Brush according to claim 1, wherein the bristles have sections which are flat in shape.

18. Brush according to claim 1, wherein the bristles have sections which are U-shaped.

19. Brush according to claim 1, wherein the cross-section of the brush is flat.

20. Brush according to claim 1, wherein the cross-section of the brush is circular.

21. Brush according to claim 1, wherein the cross-section of the brush is semi-circular.

* * * * *